US006698852B2

(12) United States Patent
Yoshida

(10) Patent No.: US 6,698,852 B2
(45) Date of Patent: Mar. 2, 2004

(54) LOW MELTING POINT METAL MATERIAL INJECTION MOLDING METHOD, INJECTION MOLDING DEVICE AND BODY BOX

(75) Inventor: Tatsuo Yoshida, Kanagawa (JP)

(73) Assignee: Sony Corporation, Tokyo (JP)

( * ) Notice: Subject to any disclaimer, the term of this patent is extended or adjusted under 35 U.S.C. 154(b) by 72 days.

(21) Appl. No.: 09/928,752

(22) Filed: Aug. 14, 2001

(65) Prior Publication Data

US 2002/0007930 A1 Jan. 24, 2002

Related U.S. Application Data

(62) Division of application No. 09/604,746, filed on Jun. 28, 2000.

(30) Foreign Application Priority Data

Jun. 30, 1999 (JP) ..... 11-186807

(51) Int. Cl.[7] ..... A47B 81/00; B22D 17/02
(52) U.S. Cl. ..... 312/223.2; 164/312; 361/683
(58) Field of Search ..... 164/113, 119, 164/312; 361/679, 683, 724; 312/223.1, 223.2, 223.3

(56) References Cited

U.S. PATENT DOCUMENTS 3,658,121 A * 4/1972 Douglas ..... 164/312
4,003,423 A * 1/1977 Shikinai et al. ..... 164/34
5,040,589 A * 8/1991 Bradley et al. ..... 164/113
5,369,549 A * 11/1994 Kopp et al. ..... 361/679
5,580,507 A * 12/1996 Williamson et al. ..... 264/221
5,745,341 A * 4/1998 Wolff et al. ..... 361/682
5,835,342 A * 11/1998 Hunte ..... 361/681
6,498,719 B1 * 12/2002 Bridges ..... 361/680

* cited by examiner

*Primary Examiner*—M. Alexandra Elve
*Assistant Examiner*—Len Tran
(74) *Attorney, Agent, or Firm*—Rader, Fishman & Grauer PLLC; Ronald P. Kananen

(57) ABSTRACT

A concave design forming unit with the desired form is formed on the surface of a molded component for use in injection molding using a low melting point metal material. An injection molding cavity of the predetermined shape is formed from a metal mold, and after mold curing the molten metal, the molded goods are removed from the injection molding cavity. The injection molding cavity is formed by a first metal mold unit and a second metal mold unit, the metal mold having a trapezoidal concave design forming unit with the predetermined height formed on the metal mold inside surface of the first metal mold unit or the second metal mold unit forming said injection molding cavity. The metal mold is heated to a predetermined metal mold temperature, and the molten metal heated to the predetermined molten temperature will be injected into the injection molding cavity of the heated metal mold at the predetermined injection rate. After the injected molten metal injected it is chilled and solidified, the first metal mold unit and the second metal mold unit are separated and the molded component removed from the injection molding cavity.

4 Claims, 7 Drawing Sheets

LOW MELTING POINT METAL MATERIAL INJECTION MOLDING METHOD, INJECTION MOLDING DEVICE AND BODY BOX

RELATED APPLICATION

This application is a divisional application of Application Ser. No. 09/604,746, filed on Jun. 28, 2000.

BACKGROUND OF THE INVENTION

1. Field of the Invention

The present invention relates to an injection molding method of low melting point metal material, injection molding device and box, and more particularly, to injection molding the low melting point metal material that is the material of the shell of a notebook personal computer (hereinafter referred to as notebook PC).

2. Description of the Related Art

Shown in FIG. 1, the magnesium alloy of a low melting point metal material has been commonly used for the shell 60 forming the outer part of a notebook PC 50. By taking advantage of the feature of the magnesium alloy, the personal computer main body is trimmed down to weigh less and has increased hardness.

In the case of manufacturing the shell 60 of the notebook PC, molten metal of magnesium alloy heated to the predetermined temperature is poured at the predetermined injection rate into the predetermined shape injection molding space, hereinafter referred to as a cavity, provided in a metal mold by using the injection molding device of a hot chamber system, for example. After chilling and solidifying the injected molten metal, the injected molten metal is removed from the metal mold as the molded goods, and the shell 60 having the same shape as the cavity can be manufactured.

Then, on the surface of the manufactured shell 60, the model name and logo marks are printed and mounted into the main body of the notebook PC and shipped for later use.

However, since the model name and logo marks are displayed on the surface of the shell 60 by printing, it was difficult to give a high quality impression and upscale quality feeling to the user by the shell 60 of the notebook PC. Accordingly, in recent years it has been required to form the model name and logo marks with characters to be expressed with a slightly dented form, or detent, or etchlike with respect to the surface of the shell 60 (hereinafter referred to as impressed character).

As shown in FIG. 2, in the case of manufacturing a shell with impressed characters formed with the name of model type and logo mark using impressed characters on the surface by using the hot chamber system injection molding device 1, a metal mold 11 having the shape wherein a cavity 2 formed by the left metal mold 3A and the right metal mold 3B corresponds to the shell with impressed characters will be used.

The injection molding device 1 injects the molten metal of magnesium alloy heated to a temperature greater than the metal mold 3 into the cavity 2 from the injection device 9. After chilling and solidifying said injected molten metal, the right metal mold 3B is moved in the direction of an arrow C by the hydraulic cylinder 8 and the left metal mold 3A and the right metal mold 3B are separated and the molded goods is taken out from the cavity 2.

However, as shown in FIG. 3, the molten metal that was poured into the cavity 2 of the metal mold 3 reflects irregularly in the direction shown by an arrow at the convex part 4 provided corresponding to the impressed characters formed on the surface of the shell. Deviation occurs in the flow of molten metal poured into the cavity 2 and the molten metal does not flow constantly in the cavity 2, and thus interference streaks occur on the surface of the shell with impressed characters after it is molded.

Moreover, in the injection molding device 1 of the hot chamber system, since the molten metal that was heated to a higher temperature than the metal mold 3 is poured into the cavity 2 of the metal mold 3 heated to the predetermined temperature at the predetermined injection rate, the molten metal of high temperature runs against the convex part 4 severely.

Accordingly, in the injection molding device 1, the convex part 4 of the left metal mold 3A is further heated and deteriorated. Thus, breakage occurs, for example the edge of the convex part 4 is chipped. Thus, in the box with the impressed characters, after it is molded by the injection molding device 1, a disadvantage occurs such as the contour of the impressed character part becomes unclear due to the chipped edge of the convex part 4.

At the sane time, in the injection molding device 1 of the hot chamber system, since the high temperature molten metal runs severely against the convex part 4 and the convex part 4 is further heated, the molten metal sticks onto the surface of the convex part 4 while cooling and solidifying the molten metal, and thus making the molded goods difficult to be taken out from the metal mold 3. And as a result, unevenness occurs on the bottom surface of the impressed character formed on the surface of the shell with the impressed characters.

Thus, in the conventional injection molding device 1, since such as interference streaks occur on the surface of the shell with impressed characters after being molded, disadvantages such as the contour of the impressed character formed on the surface becomes unclear and the unevenness occurs on the bottom surface, and the breakage such as chip occurs on the convex part 4 of the left metal mold 3A, it has been difficult to manufacture a large quantity of shells with impressed characters without defect, and this created a problem that yields of shells with good quality were not good

SUMMARY OF THE INVENTION

In view of the foregoing, an object of this invention is to provide an injection molding method of low melting point metal material capable of easily forming the desired shape impressed design molding unit on the surface of the molded goods in the case of injection molding using the low melting point metal material, an injection molding device and a shell provided with the impressed design molding unit and having high quality.

The foregoing object and other objects of the invention have been achieved by providing an injection molding method of low melting point metal material, an injection molding device, and a shell. In the injection molding method of low melting point metal material for injecting the molten metal formed of low melting point metal material into the injection molding cavity with the predetermined shape provided in the metal mold, and after cooling off and solidifying the molten metal, taking out molded goods from the injection molding cavity. The injection molding cavity is formed inside by the first metal mold unit and the second metal mold unit contacted, the metal mold having the trapezoidal shape convex design forming unit with the predetermined height on the metal mold inside surface of the first metal mold unit or the second metal mold unit forming the injection molding cavity is heated to the predetermined metal molding temperature, and the molten metal heated to the predetermined melting temperature is injected into the injection molding cavity in the heated metal mold. After the injected molten metal is cooled off and solidified, the molded goods is taken out from the injection molding cavity by separating the first metal mold unit and the second metal unit. The flow of the molten metal that was poured into the injection molding cavity would not be disturbed but can be poured in at a uniform rate because of the oblique side of the convex design forming unit having the trapezoidal shape. And thus, the concave design forming unit having clear contour corresponding to the convex design forming unit can be formed on the surface of the shell easily.

Furthermore, according to the present invention, in the injection molding device for injecting the molten metal formed of low melting point metal material heated to the predetermined temperature into the injection molding cavity with the predetermined shape provided in the metal mold heated to the predetermined metal mold temperature and taking out the molded goods from the injection molding cavity after cooling off and solidifying the molten metal injected; since the metal mold forms an injection molding cavity by the first metal mold unit in contact with the second metal mold unit and the trapezoidal convex design molding unit with the predetermined height will be provided on the metal mold inside surface of the first metal mold unit or the second metal mold unit forming the injection molding cavity, the flow of molten metal poured into the injection molding cavity would not be disturbed because of the oblique side of the trapezoidal convex design molding unit. The molten metal can be poured into the cavity constantly and the concave design molding part having the clear contour corresponding to the convex design molding unit can be easily formed on the surface of the shell.

Furthermore, according to the present invention, in the shell for electronic equipment to be obtained by injecting the molten metal formed of low melting point metal material heated to the predetermined temperature into the injection molding cavity of the predetermined shape provided in the metal mold heated to the predetermined metal mold temperature at the predetermined injection speed, and after cooling off and solidifying the molten metal injected, for taking out the molded goods from the injection molding cavity, since the trapezoidal concave design forming unit having the oblique side tilted the predetermined angle to the virtual side normal to the surface towards the bottom side from the surface is provided, the static load strength and twisting strength will be increased and simultaneously, smooth touch and the feeling of high quality can be obtained by the oblique side having the trapezoidal tilted angle of the concave design forming unit The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiments of this invention will be described with reference to the accompanying drawings.

According to the present invention, by injection molding the magnesium alloy of the low melting point metal material as the material for a shell to be used for the main body of a notebook PC by using the metal mold (to be described later), a shell with concave, or impressed characters on which characters to be shown by a slightly dented form, hereinafter referred to as concave characters, on the surface will be formed.

Here, the metal element substance having the melting point lower than 650° C. or alloys based on these metals are called as the low melting point metal material, and include for example, aluminum, magnesium, zinc, tin, lead, bismuth, terbium, tellurium, cadmium, thallium, astatine, polonium, selenium, lithium, indium, sodium, potassium, rubidium, cesium, francium, gallium, all of which can be listed as low melting point metal materials. Especially, single substance of aluminum, magnesium, lead, zinc, bismuth, tin and alloys based on these metals are desirable.

These metal substances are metal elements or alloys that can be formed, mixed and molten at the injection molding device. These metal substances can be obtained by chipping an ingot with a chipping machine, and also chipped powders obtained by chipping using the chipping machine. Furthermore, the metal substances can be formed by dropping the molten metal into a cooling-off medium such as water, and these metal substances can also be obtained by using the reduction method or the rolling dissipation electrode method.

The metal substances obtained according to these methods are comparatively small and can be easily handled, different from powder and can be easily molten in the process of being transmitted into the metal mold of the injection molding device. In this manner, the case of utilizing the magnesium alloy of "AZ91D" according to the Japanese Industrial Standard (JIS) standard will be described as an example of the low melting point metal substances in the following paragraphs.

Figure 2:
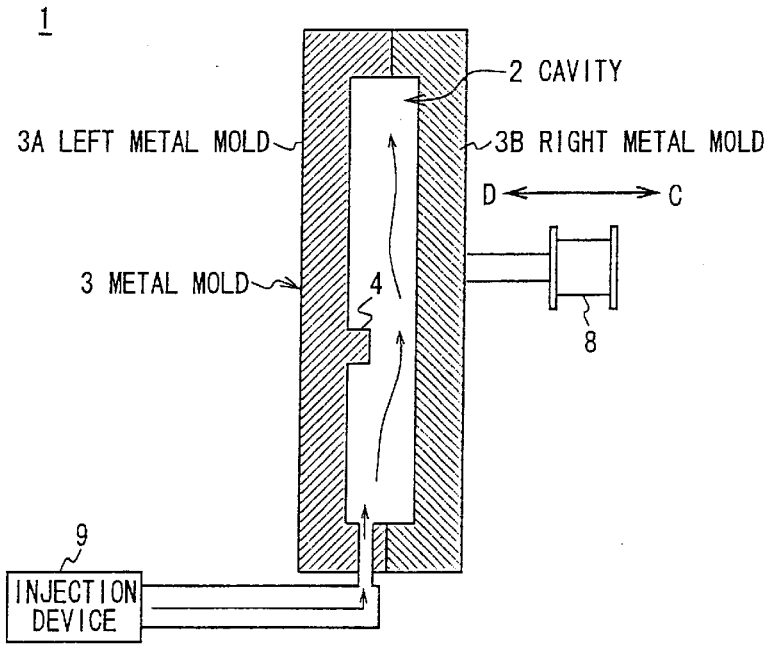
FIG. 2 (RELATED ART)
FIG. 2 is a cross-sectional view showing f a conventional injection molding device.
Figure 3:
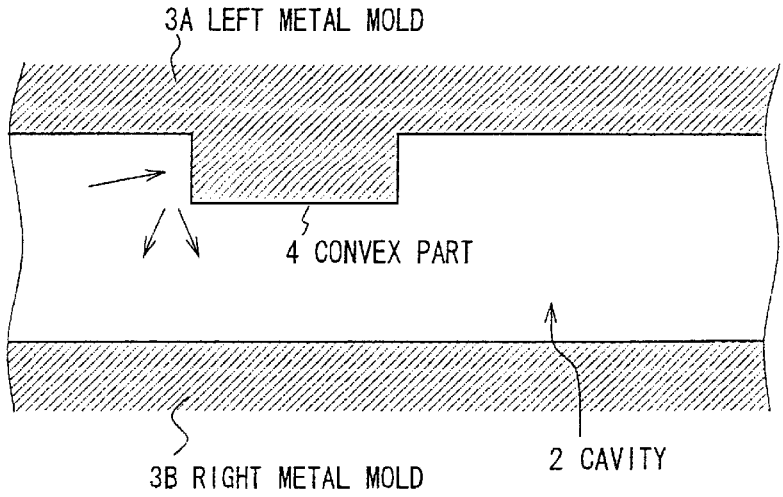
FIG. 3 (RELATED ART)
FIG. 3 is a cross sectional view illustrating the diffused reflection of the molten metal in the conventional injection molding device.
Figure 4:
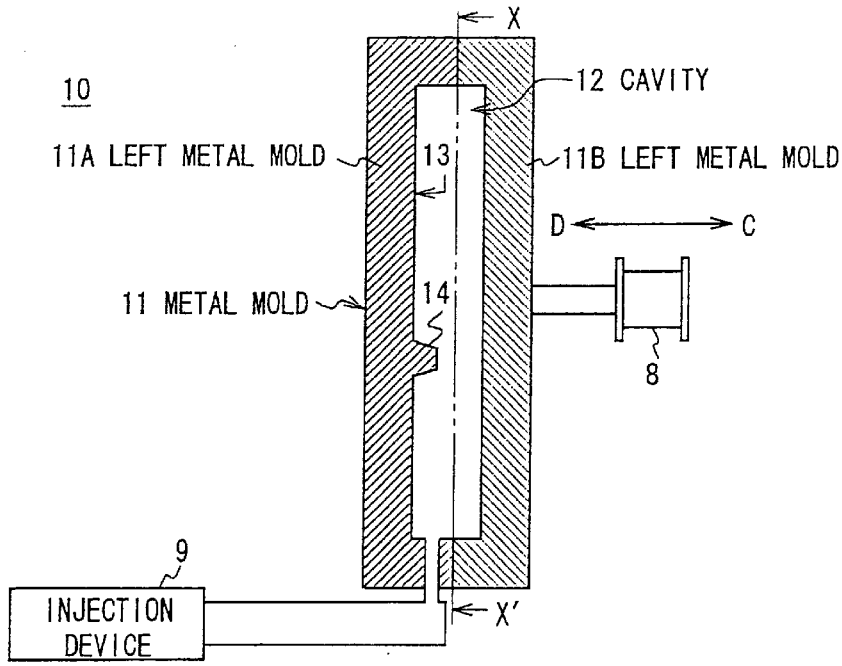
FIG. 4 is a cross-sectional view taken along Y-Y' of an injection molding device according to the present invention.
Figure 5:
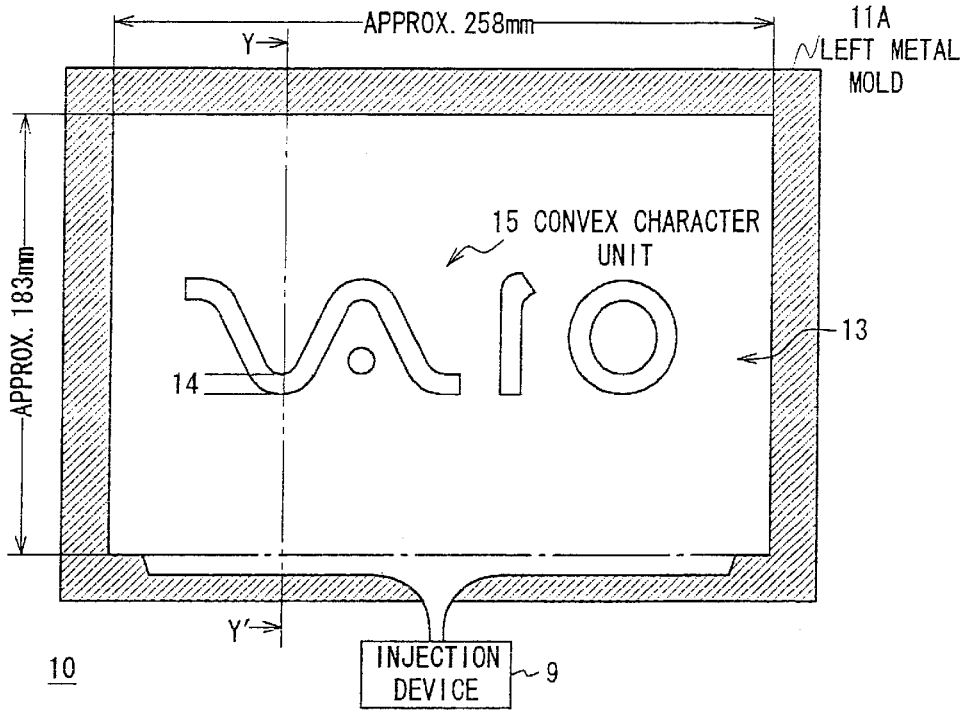
FIG. 5 is a cross-sectional view taken along X-X' of an injection molding device according to the present invention.

In FIGS. 4 and 5, in which corresponding parts of FIG. 2 are designated the same reference numerals, 10 generally shows an injection molding device of a hot chamber system. FIG. 5 is a cross sectional view of the injection molding device 10 of FIG. 4 cutting through X-X' line. And FIG. 4 shows the condition of the injection molding device 10 of FIG. 5 cutting through Y-Y' line. More specifically, the injection molding device 10 of FIG. 5 is a front view of the metal mold surface 13 of the left metal mold 11A in the metal mold 11 observing from the inside of cavity 12. Molten metal of the low melting point metal substance can be injected into the cavity 12 from the injection device 9 of the lower part at a uniform rate.

In the injection molding device 10 shown in FIG. 5, convex character unit 15 ("VAIO") as the convex design forming unit formed by characters and graphics with the predetermined shapes corresponding to the concave, or impressed characters to be formed on the surface of the shell after it is molded at the center of the metal mold inside surface 13 in the left metal mold 11A slightly protruded from the metal mold inside surface 13. This convex character unit 15 occupies approximately one third of the length of the metal mold inside surface 13 and nearly two third of the width of this metal mold inside surface 13 having the length approximately 183 mm x approximately 258 mm width.

In this case, trapezoidal convex part 14 corresponding to "V" of the convex character unit 15 is protruded from the metal mold inside surface 13 in the metal mold 11 (FIG. 4).

Figure 6:
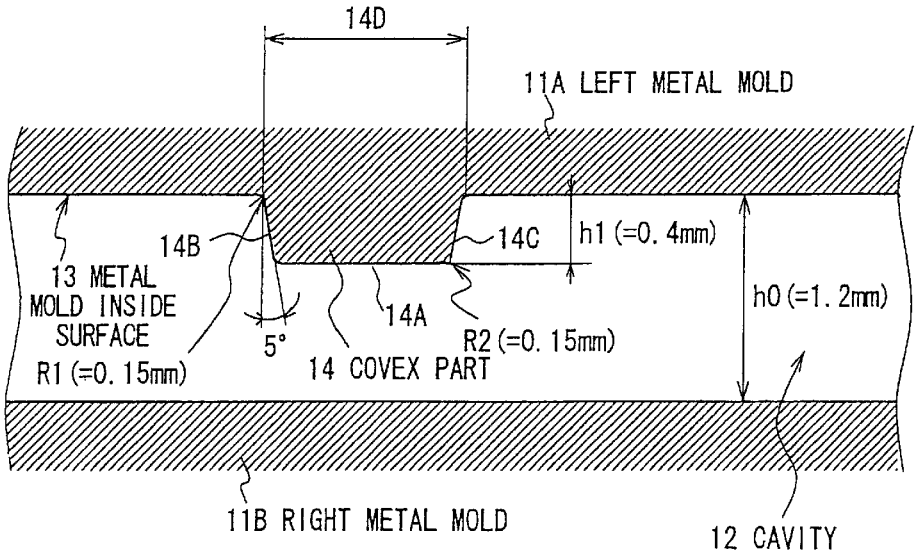
FIG. 6 is a cross-sectional view of a metal mold.
Figure 7:
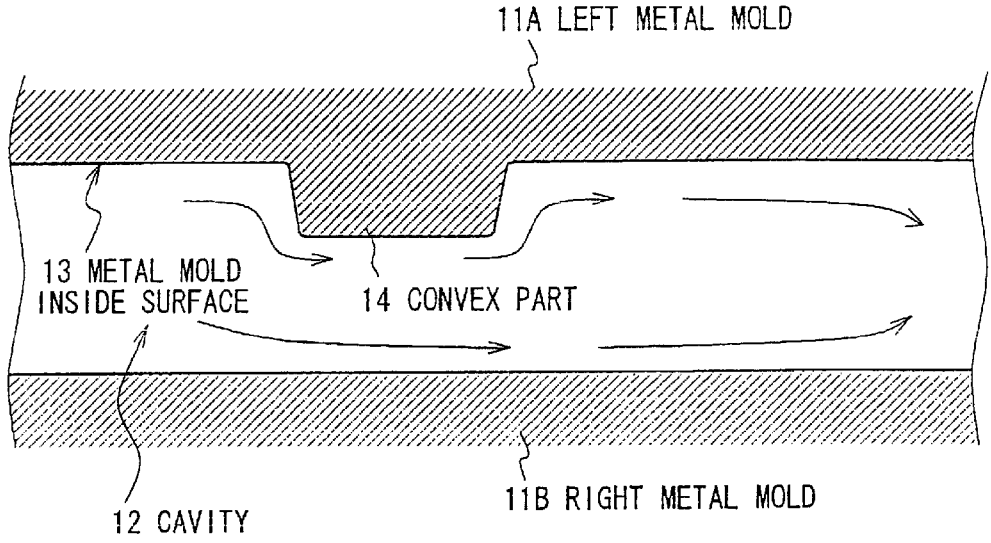
FIG. 7 shows the flowing of molten metal in the cavity.

Referring to FIG. 6, the size of the convex part 14 in the convex character unit 15 provided on the metal mold inside surface 13 of the left metal mold 11A and the space size of the cavity 12 to be formed by the fixed left side metal mold 11A as the first metal mold unit and the movable right side metal mold 11B as the second metal mold unit will be explained in detail.

The trapezoidal convex part 14 formed on the outer surface of the left metal mold 11A, i.e., the metal mold inside surface 13, is formed with the height h1 approximately 0.44 mm from the metal mold inside surface 13 to the upper bottom side 14A with respect to the space height of the cavity 12 h0 approximately 1.2 mm. Circular arc cambers R1 and R2 are each approximately 0.15 mm and are applied to the connecting part of the metal mold inside surface 13 and the oblique side 14B and 14C and the connection part of the oblique side 14B, 14A and the upper bottom side 14A respectively.

In practice, it is acceptable if the height of the trapezoid shape of the convex part 14 in the convex character unit 15 formed on the left metal mold 11 is formed within the range of approximately 0.3 mm to 0.5 mm, the cambers R1 and R2 each approximately 0.15 mm, and the radius of the circular arc is formed within the range of approximately 0.1 mm to 0.2 mm. More specifically, it may be agreeable if the height of trapezoid of the convex part 14 h1 occupies approximately 25 percent to 40 percent of the space height h0 of the cavity 12, and the radius of the circular arc of the cambers R1 and R2 occupies 8 percent to 17 percent.

At the same time, the oblique sides 14B and 14C of the trapezoidal convex part 14 are angled approximately 5 degrees with respect to the virtual side orthogonal to the metal mold inside surface 13, and the molten metal poured into the cavity 12 can easily flow into the cavity because of the inclination of the oblique sides 14B and 14C. Also, it is preferred if the oblique sides 14B and 14C are tilted approximately 4 to 6 degrees with respect to the virtual side orthogonal to the metal mold inside surface 13.

Accordingly, in the cavity 12 formed by the left metal mold 11A having the trapezoidal convex part 14 and the right metal mold 11B, it is preferred that the molten metal is injected at a uniform rate. Reflecting and diffusing of the molten metal at the convex part 14 is minimized since the convex part provided on the metal mold inside surface 13 is formed in trapezoidal shape having the oblique side 14B forming an obtuse angle to the molten metal being poured into the cavity 12.

Accordingly, since the injection molding device 10 can pour the molten metal into the cavity 12 of the metal mold 11 at a uniform rate while not disturbing the flow of said molten metal, the development of interference streaks on the surface of the box after it is molded can be prevented. Furthermore, since the molten metal can be poured into the cavity 12 at a uniform rate, the contour of concave characters can be formed clearly.

At the same time, in the injection molding device 10, since the convex part 14 is formed in the trapezoidal shape, and an impactive force of the molten metal when running against the convex part 14 will be absorbed and become weaker due to the obtuse angle of the convex part 14, the convex part 14 can be prevented from being heated to high temperature. Thus, in the injection molding device 10, the molten metal can be prevented from attaching to the surface of the convex part 14 when it is cooled off and solidified. This prevents the occurrence of level difference on the bottom surface of the concave characters in the shell with concave characters after it is formed.

Furthermore, since the injection molding device 10 weakens the impactive force of the high temperature molten metal at the time when it hits against the convex part 14 by forming the obtuse angle, it can prevent the degradation of the convex part 14 due to the high temperature and the angle chipping of convex part 14. As a result, the injection molding device 10 can remarkably improve durability of the metal mold 11.

In practice, the injection molding device 10 heats the metal mold 11 to approximately 220° C., and under this condition, it injects the molten magnesium alloy molten heated to approximately 620° C. into the cavity 12 of the metal mold 11 from the injection device 9 at the injection speed of about 80 m/s. After mold curing the injected molten metal in the cavity 12, the right metal mold 11B is moved in the direction of an arrow C by the hydraulic cylinder 19, the left metal mold 11A from the right metal mold 11B and removes the molded component that is the shell with concave characters from the metal mold 11.

Figure 8:
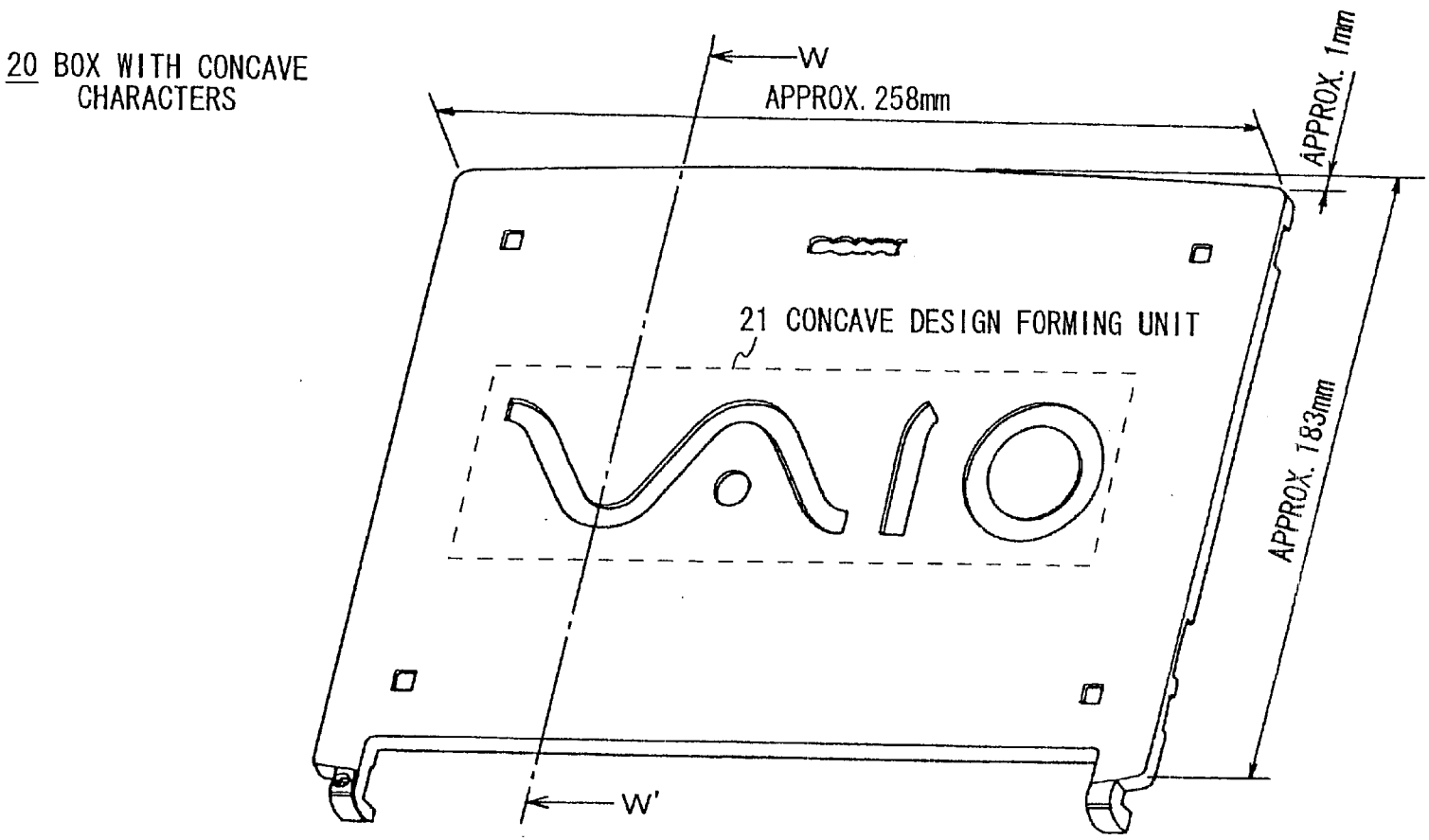
FIG. 8 is a perspective view showing a shell with impressed characters.

With this arrangement, as shown in FIG. 8, the shell 20 has impressed characters 20 obtained by injection molding using the cavity 12 of the metal mold 11 at the predetermined molten metal temperature and the predetermined injection speed. The injection molding device 10 is provided with the concave design forming unit 21 having concave characters corresponding to the convex character unit 15 (FIG. 5) formed on the metal mold inside surface 13 of the left metal mold 11A on its surface.

Figure 9:
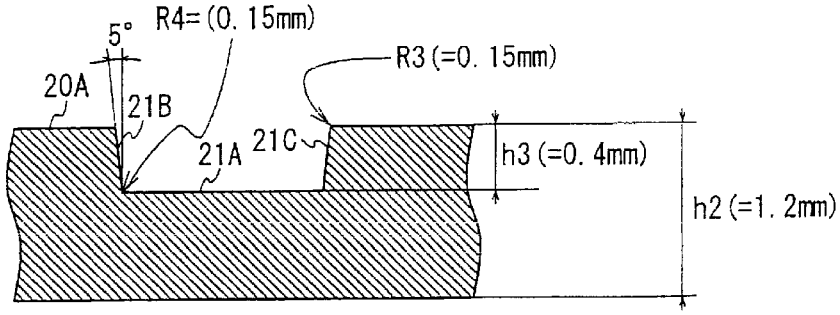
FIG. 9 is a cross-sectional view showing the cross-sectional construction of a shell with impressed characters.

As shown in FIG. 9, the cross sectional construction cutting across the line W-W' of this shell is equipped with concave characters and has the same shape and size as the cavity 12 (FIG. 6) of the metal mold 11. Character depth h3 from the surface 20A of the shell with concave characters 20 to the bottom surface 21A of the concave design forming unit 21 (FIG. 8) formed with concave characters is approximately 0.4 mm with respect to the shell having the height h2 approximately 1.2 mm. The circular arc cambers R3 and R4 are each approximately 0.15 mm and are applied respectively to connecting parts of the oblique sides 21B and 21C and the bottom surface 21A.

However, since the shell with concave characters 20 is molded corresponding to the space size of the cavity 12 of the metal mold 11, it may be acceptable that the character depth h3 approximately 0.4 mm from the surface 20A of the shell with concave characters 20 to the bottom surface 21A of the concave design forming unit 21 is formed within the range of approximately 0.3 mm to 0.5 mm. Also, regarding cambers R3 and R4 each approximately 0.15 mm, it may be acceptable if the radius of circular arc is formed within the range of approximately 0.1 mm to 0.2 mm.

More specifically, it is preferred that the character depth h3 from the surface 20A to the bottom surface 21A of the concave design forming unit 21 of the shell with concave characters 20 is approximately 25 percent to 40 percent and that the radius of the circular arc in the chamber parts R3 and R4 is approximately 8 percent to 17 percent of the shell height h2.

Furthermore, it is preferred that the oblique sides 21B and 21C of the concave design forming unit 21 formed with concave characters are slanted approximately 5° with respect to the virtual side orthogonal to the surface 20A. Additionally, it is preferable that the oblique sides 21B and 21C are tilted within the range of approximately 4 to 6 degrees.

According to the foregoing construction, during injection molding, the injection molding device 10 uses the metal mold 11 comprising the fixed side left metal mold 11A equipped with a convex character unit 15 having the convex part 14 with the height h1 of approximately 25 percent to 40 percent of the space height h0 of the cavity 12, and that cambers R1 and R2 are approximately 8 percent to 17 percent relative to the space height h0 of the cavity 12, and these components are assembled and positioned so that the oblique sides 14B and 14C are tilted approximately 4 to 6 degrees with respect to the virtual side orthogonal to the metal mold inside surface 13, and the movable side right metal mold 11.

Then, the injection molding device 10 injects the molten metal of magnesium alloy into the cavity 12 under the injection molding predetermined molten temperature and the predetermined injection speed at the predetermined metal mold temperature.

At this point, in this injection molding device 10, since the convex character unit 15 formed by the convex part 14 of trapezoidal shape is provided on the metal mold inside surface 13 of the fixed side left metal mold 11A forming the cavity 12, the molten metal of the magnesium alloy poured into the cavity 12 would not be reflected or diffused but can be poured in at a uniform rate.

Furthermore, since the injection molding device 10 is provided with the trapezoidal convex part 14 on the metal mold inside surface 13 of the left metal mold 11A of the metal mold 11, the angle will become the obtuse angle when the molten metal of the magnesium alloy hits against the tilted side 14A of the convex part 14 when it is poured into the cavity 12 and the convex part 14 can be prevented from being over heated and being chipped due to deterioration.

Accordingly, when the injection molding device 10 pours the molten metal into the cavity 12 of the metal mold 11, it can inject and pour the molten metal at a uniform rate without disturbing the flow of the molten metal. Thus, the occurrence of interference streaks on the surface of the shell with concave characters 20 can be prevented. And simultaneously, the contour of the concave design forming unit 21 can be formed clearly, and furthermore, the bottom surface 21A of the concave design forming unit 21 can be formed smoothly since chipping of the convex part 14 can be prevented.

With this arrangement, the injection molding device 10 becomes capable of mass producing the shells with concave characters 20 on which the concave design forming unit 21 can be provided easily and without defect, and as a result, yields of high quality goods can be remarkably improved.

Figure 1:
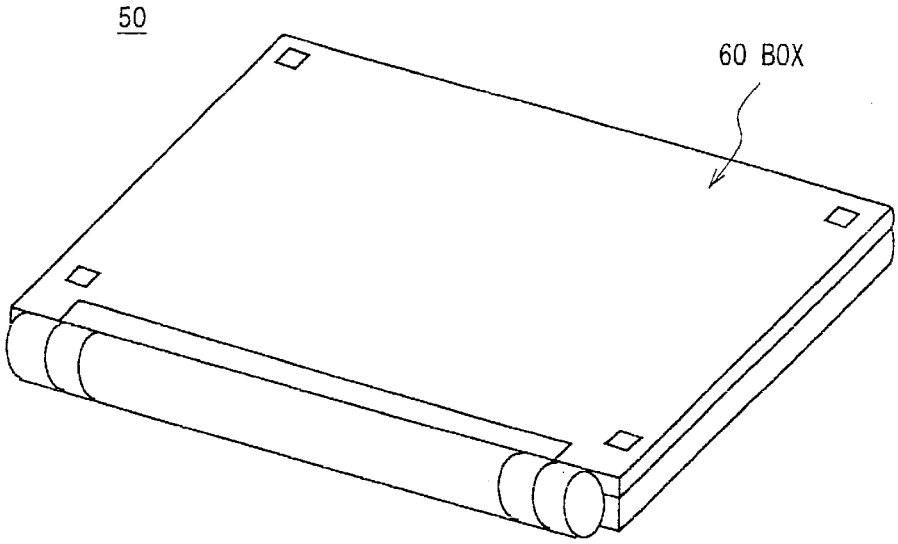
FIG. 1 (RELATED ART)
FIG. 1 is a perspective view showing a shell of the conventional notebook personal computer.
Figure 10:
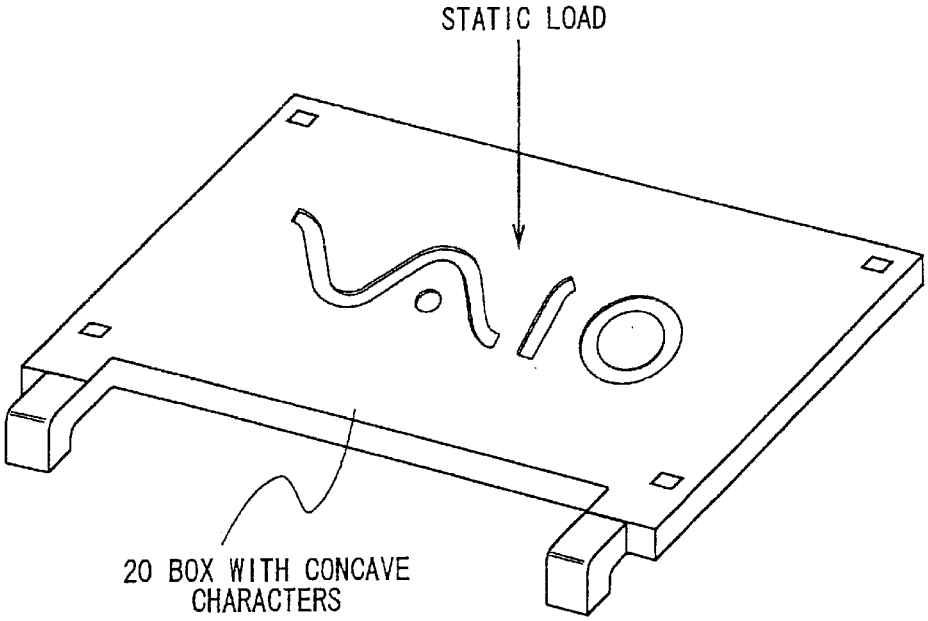
FIG. 10 is a perspective view of a shell illustrating the load strength direction.

The shell with concave character 20 thus injection molded is formed in the same shape and the same size as the cavity 12 of the metal mold 11. Since the concave design forming unit 21 occupies the central area and plays a key role, the static load strength can be remarkably increased as compared with the flat shaped shell 60 (FIG. 1) as shown in FIG. 10.

Furthermore, since the shell with concave part 20 is provided with character parts of "V" and "A" of the concave design forming unit 21 assembled together in the shape of a waveform, the twist strength will be increased. Moreover, the twist strength with respect to the direction orthogonal to the "I" character will be increased according to the character part of "I", and the twist strength with respect to all directions will be also increased according to the character part of "O".

Furthermore, the concave design forming unit 21 of the shell with concave character 20 has the trapezoidal shape corresponding to the convex design forming unit 15. Cambers are applied to its edge parts, resulting in the edges not being sharp but smooth to the touch, and thus adding the quality appearance to the user, the upscale image can be further improved.

According to the foregoing construction, since the injection molding device 10 pours the molten metal of the magnesium alloy into the cavity 12 of the metal mold 11 formed by the fixed side left metal mold 11A on which the convex design forming unit 15 having the trapezoidal convex part 14 is provided on the metal mold inside surface 13 and the mobile side right metal mold 11B, the molten metal can be regularly and constantly poured into the cavity 12 while not disturbing the flow because of the trapezoidal convex part 14 of the convex design forming unit 15. And simultaneously, the deterioration and chips due to overheating of the convex part 14 can be prevented. In this manner, the shell with concave characters 20 on which the concave design forming unit 21 of the desired shape having clear contour but having no interference streaks on the surface can be easily manufactured.

Furthermore, the embodiment described above has dealt with the case of utilizing the hot chamber system injection molding device 10. However, the present invention is not only limited to this, but may also be applied to an the injection molding device of a cold chamber system, as well as injection molding devices formed of various other systems. In such cases, the same effects as those of the above embodiment can be obtained.

Furthermore, the embodiment described above has dealt with the case where the trapezoidal oblique sides 14B and 14C are slanted approximately 4to 6 degrees with respect to the virtual side orthogonal to the metal mold surface 13. However, the present invention is not only limited to this but also approximately 8° and 10° is acceptable. In short, if the flow of molten metal to be poured into the cavity 12 would not be disturbed, various other oblique angles are acceptable.

Figure 11:
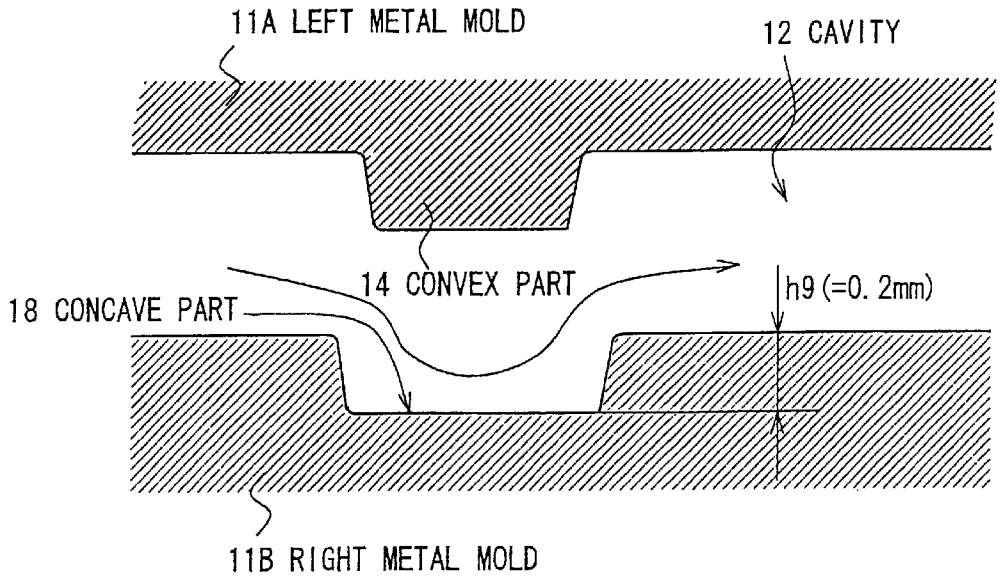
FIG. 11 is a cross sectional view showing the construction of a metal mold according to another embodiment.

Furthermore, the embodiment described above has dealt with the case of forming the cavity 12 with a mobile side right metal mold 11B having a flat surface and a fixed left metal mold 11A having the convex part 14 on the metal mold inside surface 13 as the cross sectional construction of the metal mold 11. However, the present invention is not only limited to this but also, as shown in FIG. 11, a new cavity 19 may be formed using the right metal mold 11B having the concave part 18 of the predetermined width with the predetermined depth h9 approximately 0.2 mm at the position facing to the convex part 14. In this case, since the height between the convex part 14 and the concave part 18 becomes almost equal to the space height of the cavity 19, the molten metal can flow more easily.

Furthermore, the embodiment described above has dealt with the case of using magnesium alloy as the material of the shell with concave characters. However, the present invention is not limited only to magnesium alloy but also aluminum, zinc and a variety of other low melting point metal materials can be used.

Moreover, the embodiment described above has dealt with the case of injecting the molten metal of magnesium alloy heated to approximately 620° C. into the cavity 12 at the injection rate of approximately 80 m/ms after heating the metal mold to approximately 220° C. by the injection molding device 10. However, the present invention is not limited to this but also if the concave design forming unit 21 could be manufactured without defect, it can be injection molded under various other injection molding conditions.

Figure 12:
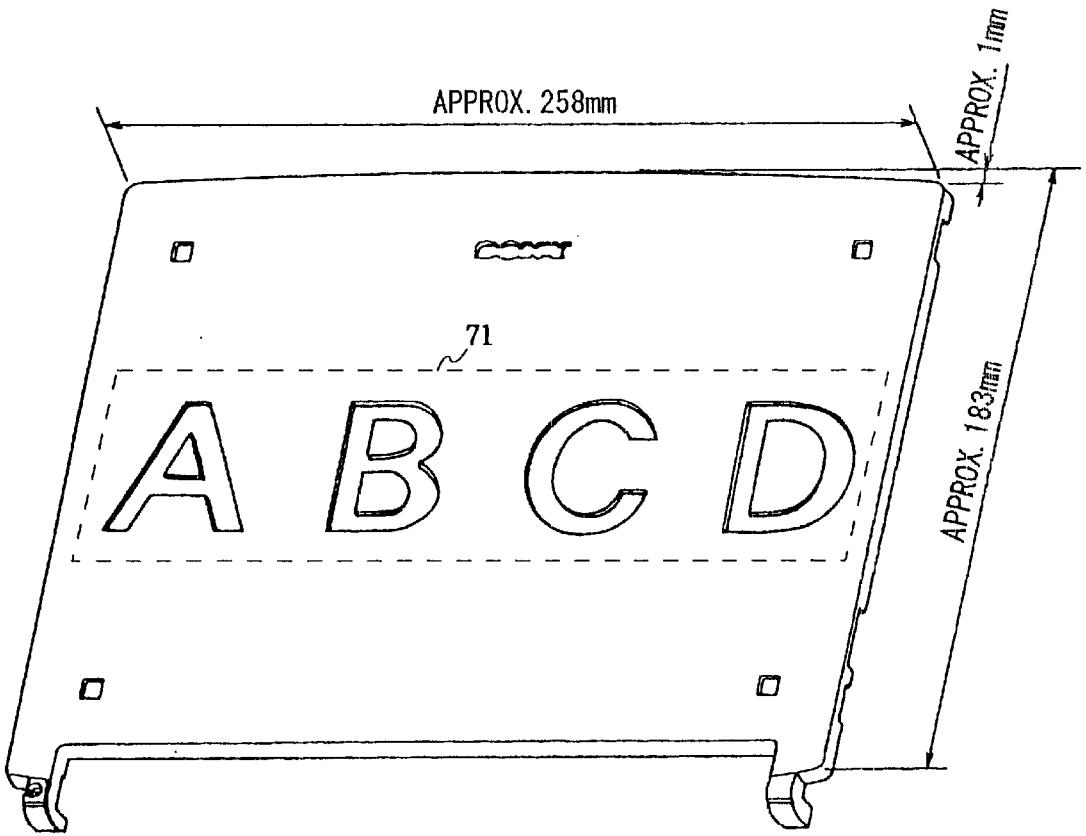
FIG. 12 is a perspective view showing a shell with impressed characters form using a concave design forming unit is provided according to another embodiment.

Moreover, the embodiment described above has dealt with the case of forming the concave design forming unit 21 of "VAIO" onto the concave character of the shell with concave characters 20. However, the present invention is not only limited to this but also the concave design forming unit 71 may be formed with various other forms such as "ABCD" as shown in FIG. 12, provided that the strength of the same level as the static load strength and the twist strength of the shell with concave characters 20 can be obtained.

Furthermore, the embodiment described above has dealt with the case of injection molding the shell with concave characters 20 to be used for a main body of a notebook PC by the injection molding device 10. However, the present invention is not only limited to this but also it may be applied to the case of injection molding the shell with concave, or impressed characters to be used for the main body of various other electronic equipment, for example a television set.

According to the present invention as described above, by constantly pouring the molten metal into the injection molding cavity without disturbing the flow of the molten metal because of the oblique side of the trapezoidal shape convex design forming unit, the concave design forming unit having a clear contour can be easily formed on the surface of the shell. The injection molding method using low melting point metal material that is capable of easily forming the concave design forming unit of the desired form on the surface of a molded component can be realized.

Furthermore, according to the present invention, by pouring the molten metal entered into the injection molding cavity at a uniform rate without disturbing the flow of the molten metal by the oblique side of the trapezoidal convex design forming unit, the concave design forming unit with a clear contour corresponding to the convex design forming unit can be formed easily on the surface of the shell. Thus, the injection molding device capable of easily forming the concave design forming unit with the desired form on the surface of the molded goods in the case of injection molding by using the low melting point metal material can be realized.

Furthermore, according to the present invention, providing the trapezoidal shape concave design forming unit on the surface of a shell for electronic equipment to be obtained by injection molding with the predetermined depth and having the oblique side with the predetermined tilted angle with respect to the virtual side orthogonal to the surface from the surface to the bottom, the static load strength and twist strength will be increased, and at the same time the smooth touch and the high quality feeling can be obtained by the oblique side having the trapezoidal slanted angle of the concave design forming unit. Thereby, the shell equipped with the concave design forming unit and having the smooth touch and high quality feeling can be realized.

While the preferred embodiments of the invention has been described, it will be obvious to those skilled in the art that various changes and modifications may be made, and that all such changes and modifications fall within the true spirit and scope of the invention in the appended claims.

What is claimed is:

1. A metal box for electronic equipment to be obtained by injecting at a predetermined velocity a molten metal formed of a low melting point metal material heated to a predetermined temperature into an injection molding cavity of a predetermined shape provided in a metal mold heated to the predetermined temperature and taking out a molded component from said injection molding cavity after cooling off and solidifying the injected molten metal, comprising:

a trapezoidal concave design forming unit formed with a predetermined depth on a surface and having oblique sides with an inclination angle of a predetermined angle with respect to a virtual side normal to said surface from said surface towards a bottom surface, wherein said inclination angle of each said oblique side is formed approximately 3 to 5 degrees with respect to a virtual side normal to said surface of said box, a depth of said concave design forming unit is formed at least approximately 25 percent to 40 percent of a depth of said box and a connecting part of said surface and said oblique sides of said box and a connecting part of said oblique sides and said bottom surface are formed in circular arcs having radii of approximately 8 percent to 17 percent of the depth of said box.

2. The metal box according to claim 1, wherein a metal element single substance having a melting point lower than 650° C. or an alloy based on the metal element single substance being used as said low melting point metal material.

3. The metal box according to claim 2, wherein a magnesium alloy is used as said low melting point metal material.

4. The metal box according to claim 2, wherein the metal element single substance is at least one of aluminum, magnesium, zinc, tin, lead, bismuth, terbium, tellurium, cadmium, thallium, astatine, polonium, selenium, lithium, indium, sodium, potassium, rubidium, cesium, francium, and gallium, or alloy based on these metal element single substances is used as said low melting point metal material.

* * * * *